US005263439A

United States Patent [19]

Doherty et al.

[11] Patent Number: 5,263,439

[45] Date of Patent: Nov. 23, 1993

[54] FUEL SYSTEM FOR COMBUSTION-POWERED, FASTENER-DRIVING TOOL

[75] Inventors: James E. Doherty, Barrington; Ernest J. Wendling, Algonquin; James W. Robinson, Mundelein, all of Ill.

[73] Assignee: Illinois Tool Works Inc., Glenview, Ill.

[21] Appl. No.: 975,835

[22] Filed: Nov. 13, 1992

[51] Int. Cl.[5] ..... B25C 1/08

[52] U.S. Cl. ..... 123/46 SC; 123/484

[58] Field of Search ..... 123/46 SC, 478, 484; 227/8, 10

[56] References Cited

U.S. PATENT DOCUMENTS

| | | | |
|---|---|---|---|
| 2,926,642 | 3/1960 | Huber | 123/46 SC |
| 3,042,010 | 7/1962 | McCrory et al. | 123/46 SC |
| 3,769,950 | 11/1973 | Braun | 123/46 SC |
| 3,967,688 | 7/1976 | Inenaga et al. | 123/46 SC |
| 4,200,213 | 4/1980 | Liesse | 123/46 SC |
| 4,483,474 | 11/1984 | Nikolich | 123/46 SC |
| 4,739,915 | 4/1988 | Cotta | 123/46 SC |
| 5,133,329 | 7/1992 | Rodseth et al. | 123/46 SC |
| 5,181,495 | 1/1993 | Gschwend et al. | 123/46 SC |

*Primary Examiner*—Tony M. Argenbright
*Assistant Examiner*—M. Macy
*Attorney, Agent, or Firm*—Schwartz & Weinrieb

[57] ABSTRACT

For use in a combustion-powered, fastener-driving tool having a combustion chamber, a source of a combustible fuel, and a switch that must be closed to enable the tool, a fuel system comprises a fuel injector, which includes a normally closed, solenoid-energized valve between the fuel source and the combustion chamber, and an electronic circuit responsive to the switch for energizing the solenoid to open the valve when the switch is closed and for deenergizing the solenoid after a time interval. A resistive-capacitive network defining the time interval includes a first resistor, a second resistor arranged to be selectively connected in parallel therewith, a thermistor connected in parallel therewith, and a variable resistor connected to the parallel resistors. Another network effects a time delay between closure of the switch and energization of the solenoid. Optionally, another network varies the time interval in response to ambient pressure.

23 Claims, 3 Drawing Sheets

Fig. 2
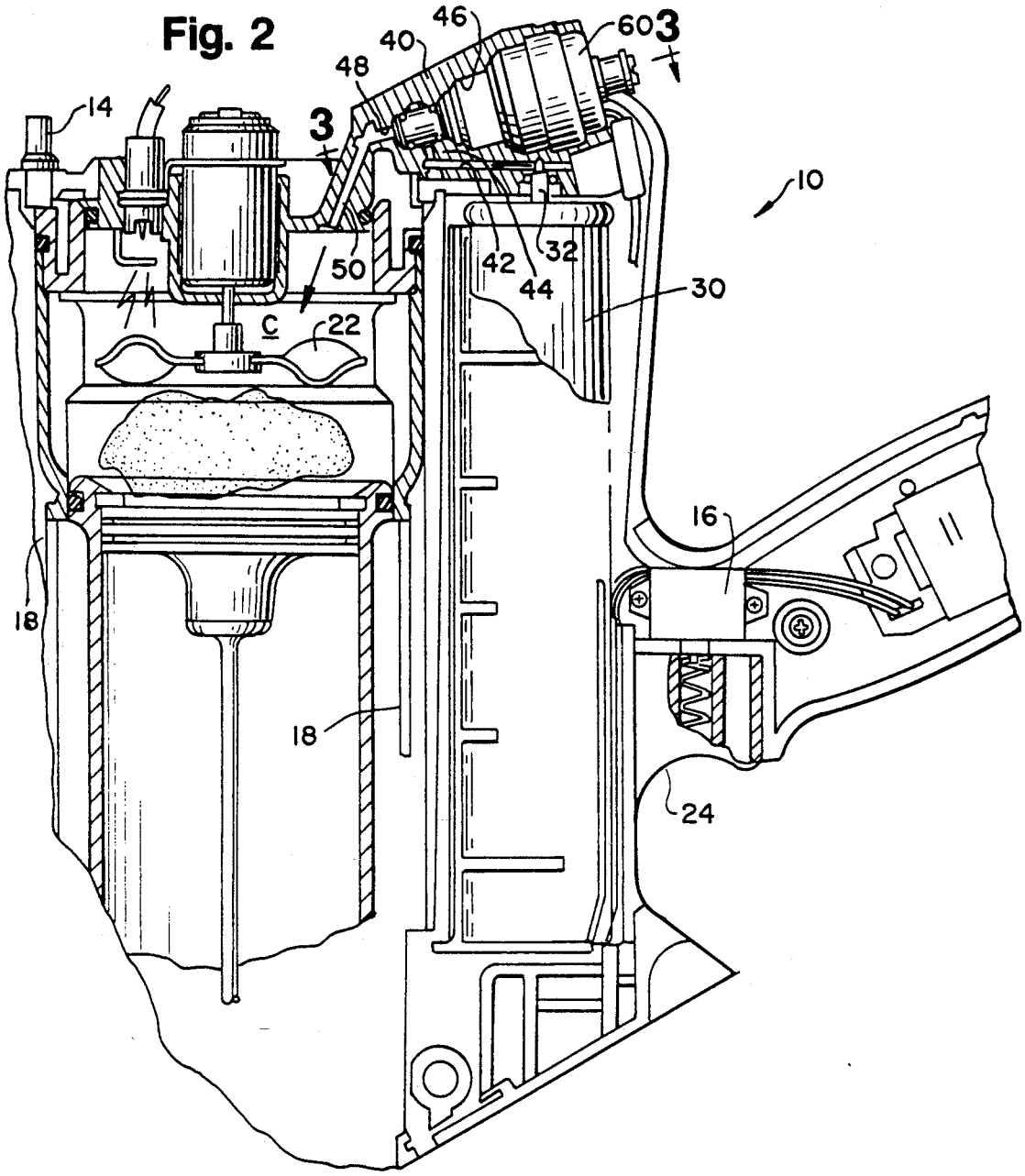
Fig. 3
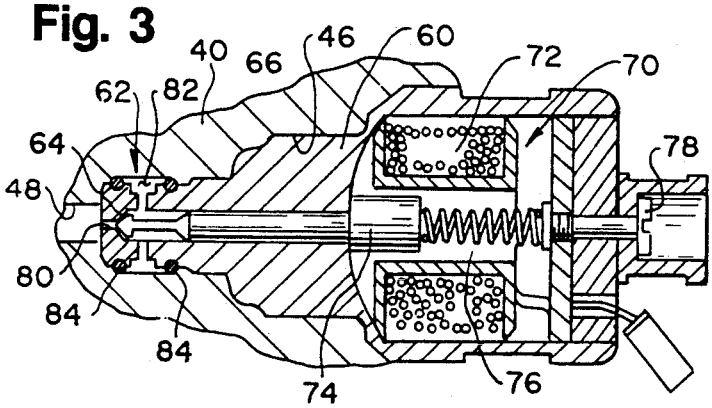
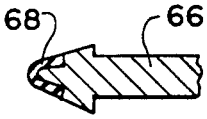
Fig. 4

FUEL SYSTEM FOR COMBUSTION-POWERED, FASTENER-DRIVING TOOL

TECHNICAL FIELD OF THE INVENTION

This invention pertains to a fuel system for a combustion-powered, fastener-driving tool having a switch that must be closed to enable ignition of a combustible fuel in a combustion chamber of the tool, whereby the fuel is permitted to flow from a source into the combustion chamber for a time interval after a switch is actuated.

BACKGROUND OF THE INVENTION

Combustion-powered, fastener-driving tools, such as combustion-powered, nail-driving tools and combustion-powered, staple-driving tools are exemplified in Nikolich U.S. Pat. Re. No. 32,452, Nikolich U.S. Pat. Nos. 4,552,162, No. 4,483,474, and No. 4,403,722, and Wagdy U.S. Pat. No. 4,483,473.

Such a tool includes switches that must be closed to enable ignition of a combustible fuel in a combustion chamber of the tool. These switches include a head switch and a trigger switch. The head switch is closed by pressing a workpiece-contacting element, which is mounted operatively to a nosepiece of the tool, firmly against a workpiece. The trigger switch is closed by pulling a trigger, which is mounted operatively to a handle of the tool. An improved ignition system employing such head and trigger switches, for such a tool, is disclosed in Rodseth et al. U.S. Pat. No. 5,133,329.

As disclosed in the Nikolich patents noted above, it has been known to dispense the fuel volumetrically from a pressurized container, by means of a mechanical valve, when the workpiece-contacting element is pressed firmly against a workpiece. The mechanical valve enables a specific volume of the fuel to enter the combustion chamber. A pressurized container useful in such a tool is disclosed in Nikolich U.S. Pat. No. 5,115,944.

It has been found that when a tool of a different size or a combustible fuel having different properties is used, or when the tool is used at different conditions of ambient temperature or at a different altitude, it may be then necessary to employ a different valve enabling a different volume of the combustible fuel to enter the combustion chamber, so as to enable the tool to perform consistently.

There has been a need, to which this invention is addressed, for an improved system for controlling a combustible fuel entering the combustion chamber.

SUMMARY OF THE INVENTION

This invention provides for use in a combustion-powered, fastener-driving tool having a combustion chamber and a source of a combustible fuel, an improved system for controlling the combustible fuel entering the combustion chamber. Typically, such a tool has switches that must be closed to enable the tool to be fired.

Broadly, the system includes means for injecting the fuel into the chamber for a controllable, predetermined time interval, to thereby control the volume of fuel injected. The system may further include means for varying the time interval in response to variations in ambient temperature. The system may further include means for varying the time interval in response to variations in ambient pressure.

In a preferred embodiment, the improved system employs a fuel injector, which includes a normally closed valve with an inlet adapted to communicate with the fuel source and an outlet adapted to communicate with the combustion chamber, and which includes a solenoid actuatable to open the valve. The fuel injector is arranged for permitting the fuel to flow from the source into the combustion chamber when the fuel valve is opened and for preventing the combustible fuel from flowing from the source into the combustion chamber when the valve is closed.

In the preferred embodiment, the improved system employs a solenoid controller, which includes an electronic circuit adapted to respond to one of the switches noted above for actuating the solenoid to open the valve when the switch is closed. Preferably, the electronic circuit is arranged for deactuating the solenoid after a time interval to permit the valve to close. Preferably, moreover, the electronic circuit includes a resistive-capacitive network defining the time interval.

The resistive-capacitive network noted above may include, along with resistors, a thermistor responsive to ambient temperature. Preferably, if a thermistor is included, it is connected in parallel with the first resistor. Preferably, moreover, the thermistor has a negative temperature coefficient of resistance.

The same network may include a first resistor and a second resistor arranged to be selectively connected in parallel with the first resistor to condition the system for use at higher altitudes and to be selectively disconnected to condition the system for use at lower altitudes. It may include a third resistor, preferably a variable resistor, which is connected to the first resistor if the second resistor is disconnected and to the first and second resistors if the second resistor is connected in parallel with the first resistor.

Preferably, the electronic circuit includes another resistive-capacitive network, which is arranged to effect a time delay between closure of the switch and actuation of the solenoid.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several view, and wherein:

FIG. 2 is a fragmentary, cross-sectional view taken along line 2—2 of FIG. 1, in a direction indicated by the arrows.

FIG. 3 is an enlarged, fragmentary, cross-sectional view taken along line 3—3 of FIG. 2, in a direction indicated by the arrows.

FIG. 4 is a further enlarged, fragmentary detail of an element of a fuel injector employed in the fuel system of the illustrated tool.

DETAILED DESCRIPTION OF PREFERRED EMBODIMENT

Figure 1:
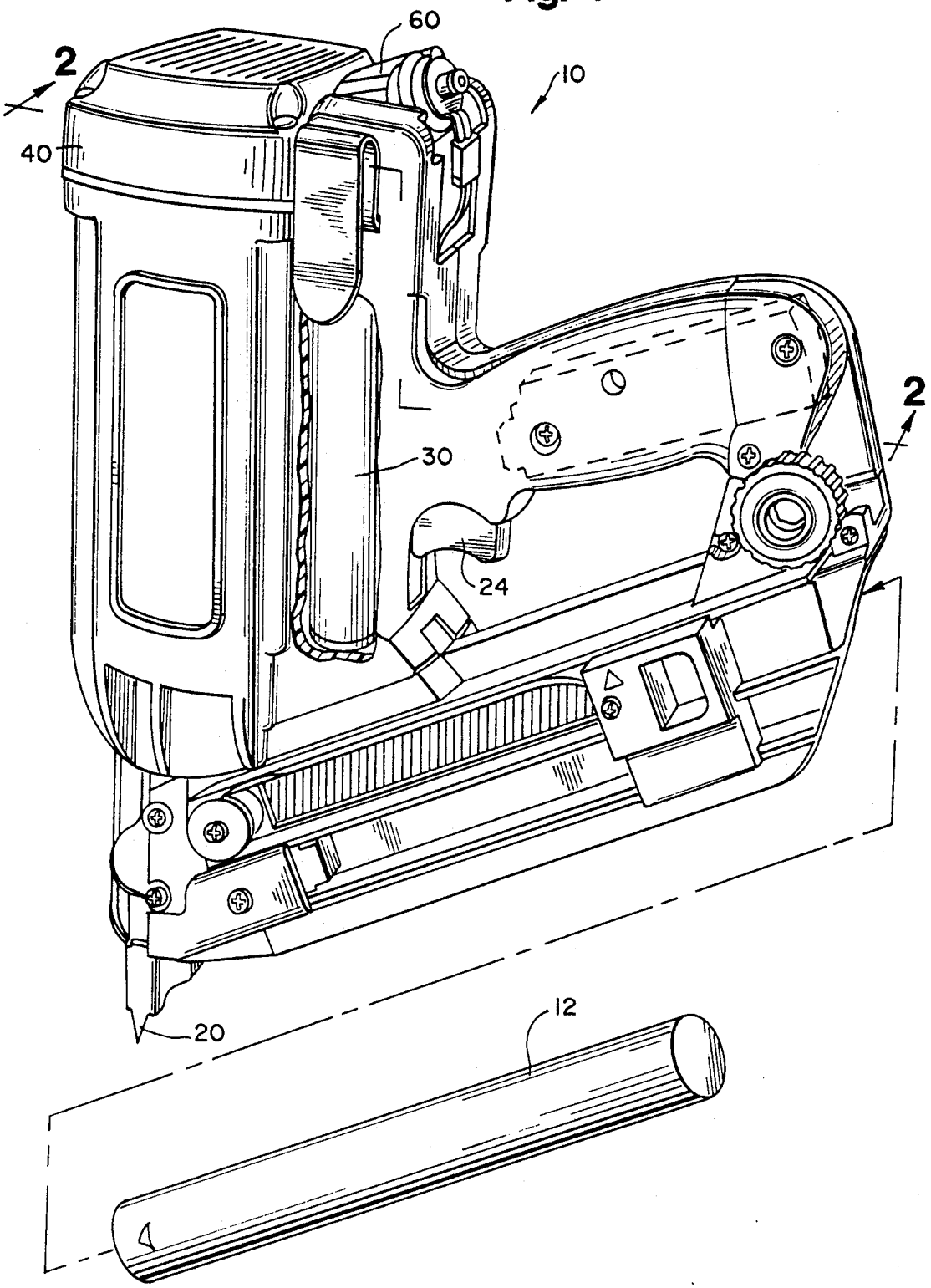
FIG. 1 is a perspective view of a combustion-powered, fastener-driving tool employing a fuel system embodying this invention.

As shown in FIGS. 1 and 2, a combustion-powered, fastener-driving tool 10 employs a fuel system constituting a preferred embodiment of this invention. The tool 10 has an ignition system comprising, among other elements, a battery 12, a head switch 14, and a trigger switch 16. Preferably, the fuel system coacts with the ignition system so that a combustible fuel is permitted to flow into a combustion chamber C of the tool 10 for a time interval after the head switch 14 is actuated. Alternatively, the fuel system coacts with the ignition system so that the combustible fuel is permitted to flow into the combustion chamber C for a time interval after the trigger switch 16 is actuated. Except for certain features illustrated in the drawings and described herein, the tool is similar to combustion-powered, fastener driving tools available commercially from ITW Paslode (a unit of Illinois Tool Works Inc.) of Lincolnshire, Illinois, under the IMPULSE trademark.

Preferably, the ignition system is similar to the ignition system disclosed in Rodseth et al. U.S. Pat. No. 5,133,329, the disclosure of which is incorporated herein by reference. The head switch 14 is opened normally and is arranged to be closed by a movable member 18 of a type known heretofore, as shown in FIG. 2, when a workpiece-contacting element 20 of a type known heretofore is pressed firmly against a workpiece (not shown) in a manner known heretofore. When the workpiece-contacting member 20 is pressed firmly against the workpiece, the movable member 18 closes the combustion chamber C, in which a turbine-type fan 22 of a type known heretofore is operable. Preferably, the head switch 14 is a photoelectric switch similar to the photoelectric switch disclosed in U.S. patent application Ser. No. 07/716,215, now U.S. Pat. No. 5,191,209, filed Jun. 17, 1991, and assigned commonly herewith, the disclosure of which .is incorporated herein by reference.

As explained in the Rodseth et al. patent, the trigger switch 16 must be also closed, while the head switch 14 is closed, to enable the ignition system to ignite the combustible fuel in the combustion chamber C. A manual trigger 24 is provided for closing the trigger switch 16.

In the tool 10, the combustible fuel is a hydrocarbon fuel supplied as a liquid from a pressurized container 30 of a known type. The pressurized container 30 has an outlet nozzle 32, which must be forcibly depressed to allow the combustible fuel to flow from the pressurized container 30, through the outlet nozzle 32. Preferably, the pressurized container 30 is similar to the pressurized container disclosed in Nikolich U.S. Pat. No. 5,115,944, the disclosure of which is incorporated by reference.

The tool 10 is arranged so that the outlet nozzle 32 is depressed when the pressurized container 30 is inserted into the tool 10. Thus, the tool 10 has a housing structure 40, into which the pressurized container 30 is inserted. The housing structure 40 has a cavity 46, which is shaped to receive a fuel injector described below. The housing structure 40 has a network of passageways 42, 44, which receive the hydrocarbon fuel flowing from the pressurized container 30, through the outlet nozzle 32. The outlet nozzle 32 opens into the passageway 42 when the pressurized container 30 is inserted into the tool 10. The passageway 44 communicates between the passageway 42 and the cavity 46. The housing structure 40 has a network of passageways 48, 50, which communicate between the cavity 46 and the combustion chamber . The passageway 48 opens into the cavity 46. The passageway 50 opens into the combustion chamber .

The fuel system comprises a fuel injector 60 mounted in the cavity 46. As explained below, the fuel injector 60 is arranged for injecting the fuel into the combustion chamber for a predetermined time interval, to thereby control the volume of fuel injected. The time interval is varied in response to variations in ambient temperature and in response to variations in ambient pressure.

Except for certain features illustrated in the drawings and described herein, the fuel injector 60 is similar to fuel injectors available commercially from Echlin Engine Systems Group of Pensacola, Florida. Heretofore, such fuel injectors have been used primarily in internal combustion engines for motor vehicles.

The fuel injector 60 comprises a normally closed valve 62, which includes a conical seat 64 and an elongate stem 66 with a conical, elastomeric tip 68, and a solenoid 70, which includes an electromagnetic coil 72, a cylindrical core 74 integral with the valve stem 66, and a coiled spring 76 arranged to bias the core 74 and the stem 66 so that the core 74 extends partly from the coil 72 and so that the tip 68 is pressed into the seat 64 to close the valve 62. The valve 62 and the solenoid 70 are arranged coaxially. The solenoid 70 is arranged in a known manner so that, when the coil 72 is energized, the core 74 is drawn further into the coil 72. Thus, when the coil 72 is energized, the tip 68 is removed from the seat 64 to open the valve 62. Then, when the coil 72 is deenergized, the spring 76 moves the core 74 and the stem 66 to close the valve 62. The solenoid 70 also includes a threaded element 78 enabling compression of the spring 76 to be adjusted within a limited range of adjustments.

The valve 62 has an axial outlet 80 communicating between the valve seat 64 and the passageway 48, which communicates with the combustion chamber C, via the passageway 50. The valve 62 has an annular inlet 82 communicating with passageway 44, which communicates with the passageway 42 receiving the combustible fuel from the outlet nozzle 32 when the pressurized container 30 is inserted into the tool 10. Two 0-rings 84 are mounted around the valve 62 to seal the valve inlet 82.

Figure 5:
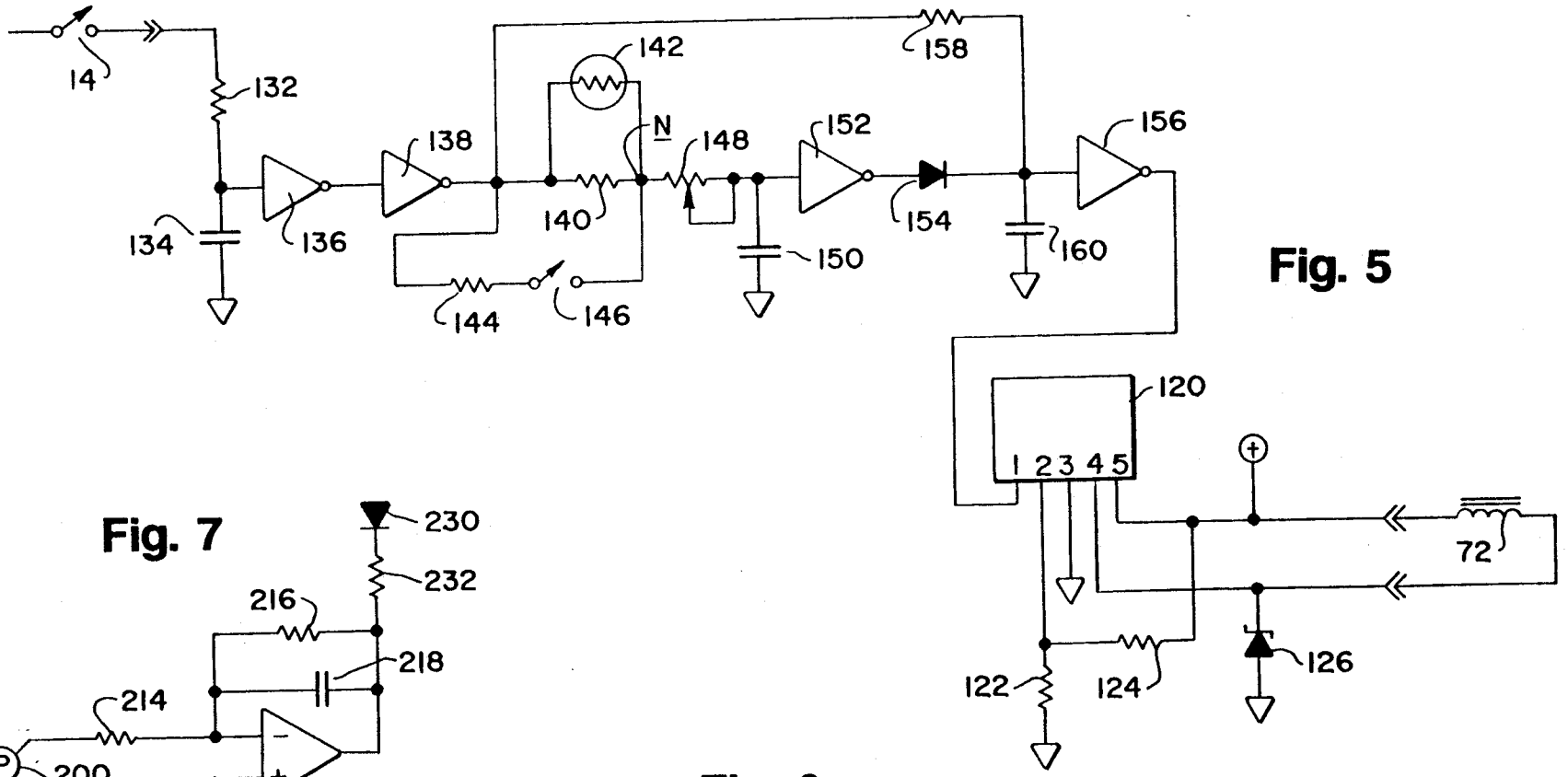
FIGS. 5 and 6 are diagrams of an electronic circuit employed in the fuel system of the illustrated tool.

As shown diagrammatically in FIG. 5, a solenoid controller including an electronic circuit 100 is provided for controlling the solenoid of the fuel injector 60 by controlling current through the solenoid coil. The circuit 100 is interconnected with an ignition circuit for the tool, preferably the improved ignition circuit disclosed in Rodseth et al. U.S. Pat. No. 5,133,329, the disclosure of which is incorporated herein by reference.

Figure 6:
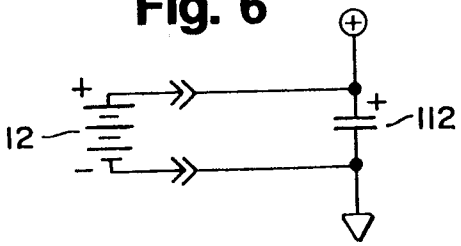

As shown in FIG. 6, the circuit 100 employs the battery 12 of the ignition circuit and the head switch 14 of the ignition circuit. The battery 12 has a maximum voltage of 6.5 volts. A capacitor 112 (4.7 $\mu$F) is connected across-s the positive and negative terminals of the battery 12.

The circuit 10 includes a solenoid driver 120 of a known type, namely a Model MC3484S2-1 integrated, monolithic solenoid driver available commercially from Motorola, Inc. of Schaumburg, Illinois. Details of the solenoid driver 120 and its operation are well known to persons having ordinary skill in the art and are outside the scope of this invention.

Pin 1 of the solenoid driver 120 is connected in a manner to be later described. Pin 2 thereof is connected to the negative terminal of the battery 12, by means of a resistor 22 (1KΩ), and to pin 5 thereof, by means of a resistor 124 (18KΩ). Pin 3 thereof is connected to the negative terminal of the battery 12. Pin 4 thereof is connected to a selected end of the solenoid coil 72. Pin 5 thereof is connected to pin 2 thereof, by means of the resistor 124, to the positive terminal of the battery 12, and to the opposite end of the solenoid coil 72. A zener diode 126 (24 V) is connected between the selected end of the solenoid coil 72 and the negative terminal of the battery 12 so as to protect the solenoid driver 120 against high countervoltages when electromagnetic fields in the solenoid coil 72 collapse.

The respective ends of the solenoid coil 72 to be thus connected to pins 4 and 5 of the solenoid driver 120 are selected so that the valve of the fuel injector is opened by the solenoid coil 72 when the solenoid coil 72 is energized and closed by the spring 76 when the solenoid coil 72 is deenergized. The solenoid driver 120 is arranged so that, when a high voltage is applied to pin 1 thereof, the solenoid coil 72 is energized, and so that, when the high voltage applied thereto is removed, the solenoid coil 72 is deenergized.

Also, the circuit 100 comprises a resistor 132 (100KΩ), a capacitor 134 (0.022 μF), an inverter (Schmitt trigger) 136, and an inverter (Schmitt trigger) 138 for filtering transients from voltages applied by the head switch 14 to the circuit 100. The resistor 132 is connected between the head switch 14 and the input pin of the inverter 136. The capacitor 134 is connected between the input pin of the inverter 136 and the negative terminal of the battery 12. The output pin of the inverter 136 is connected to the input pin of the inverter 138.

A resistor 140 (510KΩ) is connected to the output pin of the inverter 138. A thermistor 142 (500KΩ) is connected in parallel with the resistor 140. A resistor 144 (1MΩ) and a switch 146 are arranged so that the resistor 144 can be selectively connected in parallel with the resistor 140 and with the thermistor 142 by closing the switch 146, and disconnected by opening the switch 146. A variable resistor 148 (1MΩ) is connected to the resistor 140, to the thermistor 142, and to the resistor 144 if the switch 146 is closed. A capacitor 150 (0.01 μF) is connected between the variable resistor 148 and the negative terminal of the battery 112.

The variable resistor 148 and the capacitor 150 are connected to the input pin of an inverter (Schmitt trigger) 152. The output pin of the inverter 152 is connected, by means of a diode 154, to the input pin of an inverter (Schmitt trigger) 156. The diode 154 is arranged to block reverse current through the inverter 152. The output pin of the inverter 138 is connected, by means of a resistor 158, to the input pin of the inverter 156. A capacitor 160 (0.001 μF) is connected between the input pin of the inverter 156 and the negative terminal of the battery 112. The output pin of the inverter 156 is connected to pin 1 of the solenoid driver 120.

The several inverters (Schmitt triggers) noted above are provided by a Model 74HC14M (CMOS) device available commercially from National Semiconductor Corporation of Santa Clara, California. Two of six inverters (Schmitt triggers) provided thereby are not used.

The resistor 140, the thermistor 142, the resistor 144 if connected, and the capacitor 150 define a resistive-capacitive network for defining a time interval, during which the solenoid coil is energized to open the valve 62 of the fuel injector 60. The thermistor 142 is a resistor having a negative temperature coefficient of resistance. Thus, the time interval is shorter at higher temperatures, at which less fuel is required. Also, the time interval is longer at lower temperatures, at which more fuel is required. The time interval is shorter when the resistor 144 is connected in parallel with the resistor 140 and with the thermistor 142, and longer when the resistor 144 is disconnected. When the resistor 144 is connected in parallel therewith, the tool is conditioned for use at higher altitudes, at which less fuel is required. When the resistor 144 is disconnected, the tool is conditioned for use at lower altitudes, at which more fuel is required. A variable resistor (not shown) for conditioning the tool 10 for use over a range of altitudes can be advantageously substituted for the resistor 144. The variable resistor 148 can be suitably varied to condition the tool 10 for use with different fuels.

The resistor 158 and the capacitor 160 define a resistive-capacitive network for effecting a time delay between closure of the head switch 114 and energization of the solenoid coil 72.

When the head switch 14 is opened, high voltage is applied to the input pin of the inverter 136, whereby low voltage is applied by the output pin of the inverter 136 to the input pin of the inverter 138. High voltage is applied by the output pin of the inverter 138 to the input pin of the inverter 152, by means of the parallel resistors including the resistor 140 and the thermistor 142 and by means of the variable resistor 148, whereby the capacitor 150 is charged. High voltage is applied by the output pin of the inverter 138 to the input pin of the inverter 156, by means of the resistor 158, whereby the capacitor 160 is charged. Although low voltage is present at the output pin of the inverter 152, the diode 154 does not permit the capacitor 160 to discharge to the output pin of the inverter 152.

When the head switch 14 is closed, the voltage at the input pin of the inverter 136 drops sufficiently for the inverter 136 to switch its state, whereby high voltage is applied by the output pin of the inverter 136 to the input pin of the inverter 138. Thus, the voltage at the output pin of the inverter 138 drops sufficiently for the inverter 138 to switch its state, whereupon the capacitor 150 begins to discharge, by means of the resistor 148 and by means of the resistor 140, the thermistor 142, and the resistor 144 if connected, to the output pin of the inverter 138 and the capacitor 160 begins to discharge, by means of the resistor 158, to the output pin of the inverter 138. The capacitor 160 discharges more rapidly.

As the capacitor 160 discharges, the voltage at the input pin of the inverter 156 drops. When the capacitor 160 has discharged sufficiently for the inverter 156 to switch its state, high voltage is applied by the output pin of the inverter 156 to pin 1 of the solenoid controller 120, whereupon the solenoid coil 72 is energized. Thus, there is a time delay between closure of the head switch 114 and energization of the solenoid coil 72. The voltage at the output pin of the inverter 152 remains low until the capacitor 150 has discharged sufficiently for the inverter 152 to switch its state. The resistor 158 and the capacitor 160 also provide some protection against transient voltages.

When the capacitor 150 has discharged sufficiently for the inverter 152 to switch its state, high voltage is applied to the input pin of the inverter 156. Because the diode 154 provides minimal impedance compared to the resistor 158, the inverter 156 switches its state, even if the voltage at the output pin of the inverter 138 remains low. Thus, the voltage applied by the output pin of the inverter 156 to pin 1 of the solenoid controller drops, whereupon the solenoid coil is deenergized.

Advantageously, the fuel is dispensed into the combustion chamber in a time-controlled manner, rather than in a volume-controlled manner. Moveover, different components are not required for different fuels, different conditions of ambient temperature, or different altitudes. Mechanical force is not required to dispense the fuel.

Figure 7:
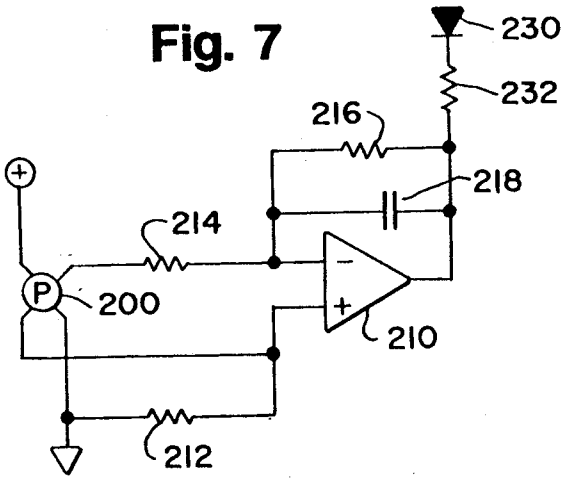
FIG. 7 is a diagram of a network that may be optionally included in the electronic circuit.

As shown in FIG. 7, a network 190 may be optionally provided in the circuit 100 for varying the time interval noted above in response to ambient pressure, as described below. Preferably, if the network 190 is included, the resistor 144 described above and the switch 146 described above are omitted.

The network 190 includes a pressure sensor 200 of a known type, which in a preferred example is responsive to absolute pressure in a range from zero psia to 14.5 psia, and an operational amplifier 210, which operates as a difference amplifier in the network 190.

In the preferred example, as shown in FIG. 7, the pressure sensor 200 is a Model MPX2101A temperature-compensated, four-pin, pressure sensor available commercially from Motorola, Inc. of Schaumberg, Illinois. The pressure sensor 200 produces an analog voltage proportional to sensed pressure. Details of such a pressure sensor are known to persons having ordinary skill in the art and are outside the scope of this invention.

The ground pin of the pressure sensor 200 is connected to the low voltage terminal of the battery 12 and by means of a resistor 212 (330KΩ) to the positive input terminal of the amplifier 210. The positive output pin of the pressure sensor 200 is connected to the positive input pin of the amplifier 210. The supply pin of the pressure sensor 200 is connected to the positive terminal of the battery 12. The negative output pin of the pressure sensor 200 is connected by means of a resistor 214 (10KΩ) to the negative input pin of the amplifier 210. The output pin of the amplifier 210 is connected by means of a resistor 216 (430KΩ) to the negative input terminal of the amplifier 210. A capacitor 218 (0.01 μF) is connected in parallel with the resistor 216. The capacitor 218 provides a one pole, low pass filter, which passes signals having frequencies less than 37 Hz.

The network 190 also includes a diode 230 connected to a node N (see FIG. 5) between the resistors 140, 148, and a resistor 232 (10KΩ) connected between the diode 230 and the output pin of the amplifier 210. The diode 230 is connected so as to allow current to flow from the node between the resistors 140, 148, by means of the resistor 232, to the output pin of the amplifier 210 and to block current from flowing oppositely.

The network 190 is arranged so that the amplifier 210 amplifies the voltage differential applied to its respective input pins by a factor defined by the resistors of the network 190. In the preferred example, the output pin of the amplifier 210 exhibits a voltage of 4.88 V at sea level, a voltage of 4.15 V at an elevation of 5000 feet above sea level, and so on. Whenever the voltage at the output pin of the amplifier 210 drops sufficiently for the diode 230 to conduct current from the node between the resistors 140, 148, by means of the resistor 232, to the output pin of the amplifier 210, the voltage available for charging the capacitor 150 drops accordingly and the time interval defined by the resistive-capacitive network including the capacitor 150 is shortened accordingly.

Herein, all values stated parenthetically for elements of the electronic circuit 100 are exemplary values, which are useful in a preferred example of the preferred embodiment illustrated in the drawings and described above. Such values are not intended to limit this invention.

In an alternative embodiment (not shown) of this invention, the electronic circuit 100 employs the trigger switch 16, as and where it employs the head switch 14 in the preferred embodiment illustrated in the drawings and described above.

Various other modifications may be made in the fuel system disclosed herein without departing from the scope and spirit of this invention. It is therefore to be understood that within the scope of the appended claims, the present invention may be practiced otherwise than as specifically described herein.

We claim

1. For use in a combustion-powered, fastener-driving tool having a combustion chamber, a source of a combustible fuel, and a switch that must be closed to enable ignition of the fuel in the combustion chamber, a system for controlling the fuel entering the combustion chamber, the system comprising (a) means including a normally closed valve with an inlet adapted to communicate with the fuel source and with an outlet adapted to communicate with the combustion chamber and including a solenoid energizable to open the valve for permitting the fuel to flow from the source into the combustion chamber when the valve is opened and for preventing the combustible fuel from flowing from the source into the combustion chamber when the valve is closed and (b) means including an electronic circuit adapted to respond to the switch for energizing the solenoid to open the valve when the switch is closed.

2. The system of claim 1 wherein the solenoid-controlling means is arranged for deenergizing the solenoid after a time interval to permit the valve to close.

3. The system of claim 2 wherein the electronic circuit includes a resistive-capacitive network defining the time interval.

4. The system of claim 3 wherein the resistive-capacitive network defining the time interval includes a thermistor responsive to ambient temperature.

5. The system of claim 3 wherein the resistive-capacitive network defining the time interval includes a first resistor and a second resistor arranged to be selectively connected in parallel with the first resistor to condition the system for use at higher altitudes and to be selectively disconnected to condition the system for use at lower altitudes.

6. The system of claim 5 wherein the resistive-capacitive network defining the time interval includes a third resistor connected to the first resistor if the second resistor is disconnected and connected to the first and second resistors if the second resistor is connected in parallel with the first resistor.

7. The system of claim 6 wherein the third resistor is a variable resistor.

8. The system of claim 5 wherein the resistive-capacitive network defining the time interval includes a thermistor responsive to ambient temperature and connected in parallel with the first resistor, the thermistor having a negative temperature coefficient of resistance.

9. The system of claim 8 wherein the resistive-capacitive network defining the time interval includes a third resistor connected to the parallel resistors.

10. The system of claim 9 wherein the third resistor is a variable resistor.

11. The system of claim 2 wherein the electronic circuit includes a resistive-capacitive network arranged to effect a time delay between closure of the switch and energization of the solenoid.

12. For use in a combustion-powered, fastener-driving tool having a combustion chamber, a source of a combustible fuel, and a switch that must be closed so as to enable ignition of said fuel within said combustion chamber, a system for controlling said fuel entering said combustion chamber, comprising:

(a) means including a normally-closed valve for controlling the flow of said fuel from said source into said combustion chamber; and (b) electronic electronically-controlled means for opening said valve for a predetermined time interval in response to said switch being closed so as to permit said fuel to flow from said source to said combustion chamber.

13. The system of claim 12 further including means responsive to temperature for controlling the time interval.

14. The system of claim 12, further including means responsive to pressure for controlling the time interval.

15. The system of claim 12, wherein:

said electronically-controlled means comprises a solenoid core fixedly connected to said valve, and an electromagnetic coil operatively associated with said solenoid core for actuating and deactuating said solenoid core in order to open said valve and permit said valve to close, respectively.

16. The system as set forth in claim 13, wherein:

said means responsive to temperature for controlling said time interval comprises a thermistor having a negative temperature coefficient of resistance such that said time interval is shorter at higher temperatures at which less fuel is required, whereas said time interval is longer at lower temperatures at which more fuel is required.

17. The system as set forth in claim 14, wherein:

said means responsive to pressure for controlling said time interval comprises a pressure sensor.

18. In a combustion-powered, fastener driving tool having a combustion chamber, a source of a combustible fuel, and a switch that must be closed prior to ignition of said fuel within said combustion chamber, an improved system for controlling said fuel entering said combustion chamber, comprising:

(a) means including a normally-closed valve for injecting said fuel from said source into said combustion chamber; and (b) electronically-controlled means for opening said valve for a predetermined time interval in response to said switch being closed so as to thereby control the amount of fuel injected into said combustion chamber from said source.

19. The system of claim 18, further including means for varying the time interval in response to variations in ambient temperature.

20. The system of claim 18, further including means for varying the time interval in response to variations in ambient pressure.

21. The system as set forth in claim 18, wherein:

said electronically-controlled means comprises a solenoid core fixedly connected to said valve, and an electromagnetic coil operatively associated with said solenoid core for actuating and deactuating said solenoid core in order to open said valve and permit said valve to close, respectively.

22. The system as set forth in claim 19, wherein:

said means responsive to variations in ambient temperature for varying said time interval comprises a thermistor having a negative temperature coefficient of resistance such that said time interval is shorter at higher temperatures at which less fuel is required, whereas said time interval is longer at lower temperatures at which more fuel is required.

23. The system as set forth in claim 20, wherein:

said means responsive to variations in ambient pressure for varying said time interval comprises a pressure sensor.

* * * * *